US009224342B2

(12) United States Patent
Lin

(10) Patent No.: US 9,224,342 B2
(45) Date of Patent: Dec. 29, 2015

(54) APPROACH TO ADJUST DRIVING WAVEFORMS FOR A DISPLAY DEVICE

(75) Inventor: Craig Lin, San Jose, CA (US)

(73) Assignee: E INK CALIFORNIA, LLC, Fremont, CA (US)

( * ) Notice: Subject to any disclaimer, the term of this patent is extended or adjusted under 35 U.S.C. 154(b) by 680 days.

(21) Appl. No.: 12/249,267

(22) Filed: Oct. 10, 2008

(65) Prior Publication Data

US 2009/0096745 A1 Apr. 16, 2009

Related U.S. Application Data

(60) Provisional application No. 60/979,708, filed on Oct. 12, 2007.

(51) Int. Cl.
*G09G 3/34* (2006.01)
*G09G 3/20* (2006.01)

(52) U.S. Cl.
CPC ..... *G09G 3/344* (2013.01); *G09G 3/20* (2013.01); *G09G 2320/041* (2013.01); *G09G 2320/043* (2013.01); *G09G 2320/0606* (2013.01); *G09G 2320/066* (2013.01); *G09G 2320/0693* (2013.01); *G09G 2360/145* (2013.01)

(58) Field of Classification Search
CPC ..... G09G 3/344; G09G 3/006; G09G 3/38; G02F 1/167
USPC ..... 345/107, 207, 102, 101
See application file for complete search history.

(56) References Cited

U.S. PATENT DOCUMENTS

| | | | | |
|---|---|---|---|---|
| 4,143,947 | A | 3/1979 | Aftergut et al. | |
| 4,443,108 | A | 4/1984 | Webster | |
| 4,568,975 | A * | 2/1986 | Harshbarger | 348/189 |
| 4,575,124 | A * | 3/1986 | Morrison | 283/115 |
| 5,266,937 | A | 11/1993 | DiSanto et al. | |
| 5,298,993 | A * | 3/1994 | Edgar et al. | 348/180 |
| 5,754,584 | A | 5/1998 | Durrant et al. | |
| 5,831,697 | A | 11/1998 | Evanicky et al. | |
| 5,923,315 | A * | 7/1999 | Ueda et al. | 345/581 |
| 5,926,617 | A * | 7/1999 | Ohara et al. | 358/1.9 |
| 6,005,890 | A | 12/1999 | Clow et al. | |
| 6,045,756 | A | 4/2000 | Carr et al. | |
| 6,069,971 | A | 5/2000 | Kanno et al. | |
| 6,111,248 | A | 8/2000 | Melendez et al. | |
| 6,154,309 | A | 11/2000 | Otani et al. | |

(Continued)

FOREIGN PATENT DOCUMENTS

| | | |
|---|---|---|
| WO | WO 2005/004099 | 1/2005 |
| WO | WO 2005/031688 | 4/2005 |

(Continued)

OTHER PUBLICATIONS

U.S. Appl. No. 12/046,197, Wang et al.

(Continued)

*Primary Examiner* — Sahlu Okebato
(74) *Attorney, Agent, or Firm* — Perkins Coie LLP

(57) ABSTRACT

The present invention is directed to methods for adjusting or selecting driving waveforms in order to achieve a consistent optical performance of a display device. When a method of the present invention is applied, even if there are changes in the display medium due to temperature variation, photo-exposure or aging, the optical performance can be maintained at a desired level.

6 Claims, 12 Drawing Sheets

(56) References Cited

U.S. PATENT DOCUMENTS

| | | | | |
|---|---|---|---|---|
| 6,532,008 | B1 * | 3/2003 | Guralnick | 345/419 |
| 6,639,580 | B1 | 10/2003 | Kishi et al. | |
| 6,657,612 | B2 | 12/2003 | Machida et al. | |
| 6,671,081 | B2 | 12/2003 | Kawai | |
| 6,674,561 | B2 | 1/2004 | Ohnishi et al. | |
| 6,686,953 | B1 * | 2/2004 | Holmes | 348/179 |
| 6,796,698 | B2 | 9/2004 | Sommers et al. | |
| 6,903,716 | B2 | 6/2005 | Kawabe et al. | |
| 6,914,713 | B2 | 7/2005 | Chung et al. | |
| 6,995,550 | B2 | 2/2006 | Jacobson et al. | |
| 7,006,130 | B2 * | 2/2006 | Harshbarger et al. | 348/189 |
| 7,177,066 | B2 | 2/2007 | Chung et al. | |
| 7,242,514 | B2 | 7/2007 | Chung et al. | |
| 7,283,119 | B2 | 10/2007 | Kishi | |
| 7,307,779 | B1 * | 12/2007 | Cernasov | 359/296 |
| 7,349,146 | B1 | 3/2008 | Douglass et al. | |
| 7,504,050 | B2 | 3/2009 | Weng et al. | |
| 7,710,376 | B2 | 5/2010 | Edo et al. | |
| 7,733,311 | B2 | 6/2010 | Amundson et al. | |
| 7,800,580 | B2 | 9/2010 | Johnson et al. | |
| 7,804,483 | B2 * | 9/2010 | Zhou et al. | 345/107 |
| 7,839,381 | B2 | 11/2010 | Zhou et al. | |
| 7,952,558 | B2 | 5/2011 | Yang et al. | |
| 7,999,787 | B2 | 8/2011 | Amundson et al. | |
| 8,035,611 | B2 | 10/2011 | Sakamoto | |
| 8,044,927 | B2 | 10/2011 | Inoue | |
| 8,054,253 | B2 | 11/2011 | Yoo | |
| 2002/0021483 | A1 | 2/2002 | Katase | |
| 2002/0033792 | A1 | 3/2002 | Inoue | |
| 2003/0095090 | A1 * | 5/2003 | Ham | 345/87 |
| 2003/0137521 | A1 | 7/2003 | Zehner et al. | |
| 2003/0193565 | A1 * | 10/2003 | Wen | 348/184 |
| 2004/0227746 | A1 | 11/2004 | Shih | |
| 2004/0246562 | A1 | 12/2004 | Chung et al. | |
| 2004/0263450 | A1 * | 12/2004 | Lee et al. | 345/87 |
| 2005/0001812 | A1 * | 1/2005 | Amundson et al. | 345/107 |
| 2005/0162377 | A1 | 7/2005 | Zhou et al. | |
| 2005/0179642 | A1 | 8/2005 | Wilcox et al. | |
| 2005/0185003 | A1 | 8/2005 | Dedene et al. | |
| 2005/0210405 | A1 | 9/2005 | Ernst et al. | |
| 2005/0219184 | A1 | 10/2005 | Zehner et al. | |
| 2006/0050361 | A1 | 3/2006 | Johnson | |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0164405 | A1 | 7/2006 | Zhou | |
| 2006/0187186 | A1 | 8/2006 | Zhou et al. | |
| 2006/0192751 | A1 | 8/2006 | Miyasaka et al. | |
| 2006/0262147 | A1 * | 11/2006 | Kimpe et al. | 345/690 |
| 2007/0035510 | A1 | 2/2007 | Zhou et al. | |
| 2007/0046621 | A1 | 3/2007 | Suwabe et al. | |
| 2007/0046625 | A1 * | 3/2007 | Yee | 345/156 |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 * | 4/2007 | Ishii et al. | 345/107 |
| 2007/0103427 | A1 | 5/2007 | Zhou et al. | |
| 2007/0109274 | A1 | 5/2007 | Reynolds | |
| 2007/0132687 | A1 | 6/2007 | Johnson | |
| 2007/0146306 | A1 | 6/2007 | Johnson et al. | |
| 2007/0159682 | A1 | 7/2007 | Tanaka et al. | |
| 2007/0182402 | A1 | 8/2007 | Kojima | |
| 2007/0188439 | A1 * | 8/2007 | Kimura et al. | 345/102 |
| 2007/0200874 | A1 | 8/2007 | Amundson et al. | |
| 2007/0247417 | A1 | 10/2007 | Miyazaki et al. | |
| 2007/0262949 | A1 | 11/2007 | Zhou et al. | |
| 2007/0276615 | A1 * | 11/2007 | Cao et al. | 702/68 |
| 2007/0296690 | A1 * | 12/2007 | Nagasaki | 345/107 |
| 2008/0150886 | A1 * | 6/2008 | Johnson et al. | 345/107 |
| 2008/0173719 | A1 | 7/2008 | Wang | |
| 2008/0211833 | A1 | 9/2008 | Inoue | |
| 2008/0303780 | A1 | 12/2008 | Sprague et al. | |
| 2009/0096745 | A1 | 4/2009 | Sprague et al. | |
| 2009/0267970 | A1 | 10/2009 | Wong et al. | |
| 2010/0134538 | A1 | 6/2010 | Sprague et al. | |
| 2010/0194733 | A1 | 8/2010 | Lin et al. | |
| 2010/0194789 | A1 | 8/2010 | Lin et al. | |
| 2010/0295880 | A1 | 11/2010 | Sprague et al. | |

FOREIGN PATENT DOCUMENTS

| | | |
|---|---|---|
| WO | WO 2005/034076 | 4/2005 |
| WO | WO 2009/049204 | 4/2009 |
| WO | WO 2010/132272 | 11/2010 |

OTHER PUBLICATIONS

U.S. Appl. No. 12/115,513, Sprague et al.
U.S. Appl. No. 12/772,330, Sprague et al.
U.S. Appl. No. 61/255,028, Sprague et al.
U.S. Appl. No. 61/295,628, Lin et al.
U.S. Appl. No. 61/296,832, Lin.
U.S. Appl. No. 61/311,693, Chan et al.
U.S. Appl. No. 61/351,764, Lin.
Kao, WC., Ye, JA., Chu, MI., and Su, CY. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-19.
Kao, WC., (Feb. 2009,) Configurable Timing Controller Design for Active Matrix Electrophoretic Dispaly. *IEEE Transactions on Consumer Electronics*, 2009, vol. 55, Issue 1, pp. 1-5.
Kao, WC., Ye, JA., and Lin, C. (Jan. 2009,) Image Quality Improvement for Electrophoretic Displays by Combining Contrast Enhancement and Halftoning Techniques. *ICCE 2009 Digest of Technical Papers*, 11.2-2.
Kao, WC., Ye, JA., Lin, FS., Lin, C., and Sprague, R. (Jan. 2009,) Configurable Timing Controller Design for Active Matrix Electrophoretic Display with 16 Gray Levels. *ICCE 2009 Digest of Technical Papers*, 10.2-2.
Kao, WC., Fang, CY., Chen, YY., Shen, MH., and Wong, J. (Jan. 2008,) Integrating Flexible Electrophoretic Display and One-Time Password Generator in Smart Cards. *ICCE 2008 Digest of Technical Papers*, p. 4-3. (Int'l Conference on Consumer Electronics, Jan. 9-13, 2008).
International Search Report for PCT/US08/79577, mailed Jan. 2, 2009.
U.S. Appl. No. 13/289,403, filed Nov. 4, 2011, Lin, et al.
U.S. Appl. No. 13/471,004, filed May 14, 2012, Sprague et al.
U.S. Appl. No. 13/597,089, filed Aug. 28, 2012, Sprague et al.
Sprague, R.A. (May 18, 2011) *Active Matrix Displays for e-Readers Using Microcup Electrophoretics.* Presentation conducted at SID 2011, 49 Int'l Symposium, Seminar and Exhibition, May 15-May 20, 2011, Los Angeles Convention Center, Los Angeles, CA, USA.

* cited by examiner

APPROACH TO ADJUST DRIVING WAVEFORMS FOR A DISPLAY DEVICE

This application claims the benefit of U.S. Provisional Application No. 60/979,708, filed Oct. 12, 2007; which is incorporated herein by reference in its entirety.

FIELD OF THE INVENTION

An electrophoretic display is a device based on the electrophoresis phenomenon of charged pigment particles dispersed in a solvent. The display usually comprises two electrode plates placed opposite of each other and a display medium comprising charged pigment particles dispersed in a solvent is sandwiched between the two electrode plates. When a voltage difference is imposed between the two electrode plates, the charged pigment particles may migrate to one side or the other, depending on the polarity of the voltage difference, to cause either the color of the pigment particles or the color of the solvent to be seen from the viewing side of the display.

One of the factors which determine the performance of an electrophoretic display is the optical response speed of the display, which is a reflection of how fast the charged pigment particles move (towards one electrode plate or the other), in response to an applied voltage difference.

However, the optical response speed of a display device may not remain constant because of temperature variation, batch variation, photo-exposure or, in some cases, due to aging of the display medium. As a result, when driving waveforms with fixed durations are applied, the performance of the display (e.g., contrast ratio) may not remain the same because the optical response speed of the display medium has changed.

To overcome this problem, there are a couple of options available previously. One prior technique involves the use of ultra-long waveforms to allow for the slowest speed achievable during the entire lifetime of the display medium. As a result of the ultra-long waveforms, the driving time is much longer. In fact, it is frequently longer than necessary, especially when the display medium is still running at a normal speed, thus causing poor performance and requiring additional power. In addition, such technique is not applicable to gray scales.

In the case of temperature variation, typically, temperature sensors are incorporated into a display device to sense the temperature changes and the driving waveforms may be adjusted accordingly. The adjustment is based on a predetermined correlation between the optical response speed and the temperature. However such an approach has several problems. First of all, the correlation between the optical response speed and the temperature may vary from batch to batch of display devices. In addition, correlation between the optical response speed and the temperature may drift over time as the display medium ages, and therefore, the temperature sensor approach cannot solve the problem of varying optical response speeds due to aging of a display device. In addition, this approach is difficult to implement because temperature sensors are often unreliable and may not always reflect the temperature of the display medium under observation.

SUMMARY OF THE INVENTION

The waveform lengths to drive an electrophoretic display medium are pre-determined primarily by the response time of the display medium, at time of manufacture. The term "response time" is known as the time required for driving a display medium from a first color state (e.g., a low reflectance state) to a second color state (e.g., a high reflectance state) or vice versa, in a binary image system.

It is important that the waveform lengths are optimized in the binary image system because driving the display medium too short a time results in not obtaining full contrast and also in lack of bistability. Driving it too long, on the other hand, can result in slow image changes and poor bistability. It is even more important that the timing is optimized in grey level e-reader applications, since the level of grey achieved with the length and voltage of a given driving waveform depends completely on the response time of the display medium.

In light of the fact that the response time of the display medium may become longer with age, with exposure to light or at a lower temperature, techniques to determine the change in response time are needed.

The present invention proposes several such techniques which have different levels of complexity, require different levels of hardware implementation and different levels of human interaction.

The first aspect of the invention is directed to a method for adjusting the performance of a display device, which method comprises:

a) determining response time of the display device, and b) adjusting waveforms to compensate the change in the response time.

In one embodiment, in step (b) of the method, the waveforms may be lengthened.

In one embodiment, the adjustment of the waveforms in the method may be pre-programmed.

In one embodiment, step (a) is accomplished by measuring a parameter which is proportional to the response time of the display device.

In one embodiment, step (a) is accomplished by measuring the performance of the display device directly.

In one embodiment, the method is carried out only one time, multiple times or in real-time.

In one embodiment, step (b) of the method is carried out manually by a user.

In one embodiment, the method of the present invention may be accomplished with hardware, software or a combination of both.

In one embodiment, step (a) of the method is accomplished by visually comparing a grey level achieved by the display device with a reference area.

In one embodiment, the reference area comprises a number of small individual regions in a full first color state and a number of small individual regions in a full second color state. In one embodiment, the ratio of the total area of the first color state to the total area of the second color state is 1:1. The individual regions are not visually distinguishable by naked eyes.

In one embodiment, step (a) of the method is accomplished by:

i) driving a sequence of blocks in a calibration window from a first color state to different levels of a second color state with waveforms of different time lengths; and ii) identifying a block being at the full second color state or two neighboring blocks having substantially identical levels of the second color state.

In one embodiment, step (a) of the method is accomplished by:

i) driving a sequence of blocks in a calibration window from a first color state to different levels of a second color state wherein each of the blocks has a marker which has been driven to the full second color state; and ii) identifying a block in the sequence in which the marker is not visually detectable.

In one embodiment, step (a) of the method is carried out by measuring the current resulting from the motion of charged particles moving across a display medium.

The second aspect of the present invention is directed to a method for maintaining optical performance of a display device, which method comprises (a) providing at least one optical sensor to the display device;

(b) providing light from a light source, which light strikes and reflects from the surface of the display device;

(c) sensing and measuring the reflected light by the optical sensor to determine optical response speed; and (d) adjusting a driving waveform based on the optical response speed.

In one embodiment, the method further comprises establishing correlation between the reflected light and optical response speed.

In one embodiment, the method further comprises establishing correlation between the reflected light and optical density.

In one embodiment, the optical sensor is a light-to-voltage sensor.

In one embodiment, the light source is the ambient light or a combination of the ambient light and an artificial light source.

In one embodiment, the method may further comprise providing a sensor for the ambient light and determining correlation between the ambient light and optical response speed.

In one embodiment, the method may further comprise modulating the light source at a temporal modulation frequency that does not exist under ambient light condition and the optical sensor only senses light modulated at the temporal modulation frequency.

In one embodiment, the method may further comprise modulating the light source with a pseudo random or spread spectrum code sequence which is detected with a correlation filter that demodulates the coded sequence to determine a correlation peak on the response.

In one embodiment, the method may further comprise placing a narrow band optical filter on the optical sensor to filter out ambient light.

In one embodiment, the light source is an artificial light source.

In one embodiment, the artificial light source is a LED light or a laser light.

In one embodiment, adjusting the driving waveform comprises adjusting the length or voltage of the driving waveform.

In one embodiment, the driving waveform is adjusted to maintain a consistent grey scale of the display device.

In one embodiment, adjusting the driving waveform is a one time adjustment.

In one embodiment, the driving waveform is adjusted multiple times.

In one embodiment, adjusting the driving waveform is real time adjustment.

The third aspect of the invention is directed to a display device, which comprises (i) a display surface;

(ii) at least one optical sensor; and (iii) a light source.

In one embodiment, the display device further comprises a micro-controller which turns on the light source and records the optical response detected by the optical sensor.

In one embodiment, the light source in the display device is ambient light.

In one embodiment, the light source is an artificial light source.

In one embodiment, the artificial light source is a LED light or laser light.

In one embodiment, the display device further comprises a viewing area and a patch area wherein the patch area is outside the viewing area and the optical sensor is in the patch area.

In one embodiment, the patch area in the display device is an extension of the viewing area and the patch area and viewing area have been exposed to the same environmental and aging history.

In one embodiment, the display device is an electrophoretic display device.

In one embodiment, the optical sensor and the artificial light source are built in the display device.

In one embodiment, the optical sensor and the artificial light source are adjacent to each other or kept apart.

In one embodiment, the optical sensor and the artificial light source are built in the inside surface of the cover of the display device.

BRIEF DISCUSSION OF THE DRAWINGS

Figure 5B:
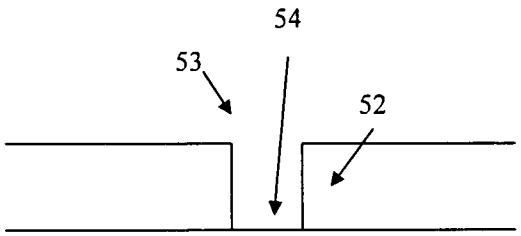
Figure 5C:
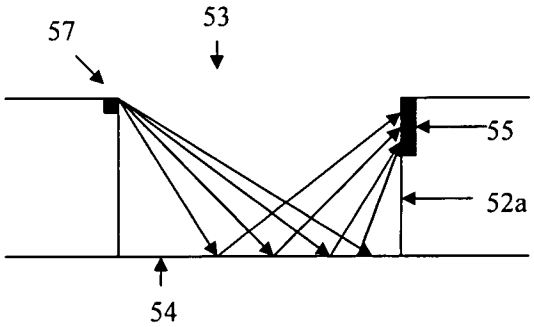
Figure 5A:
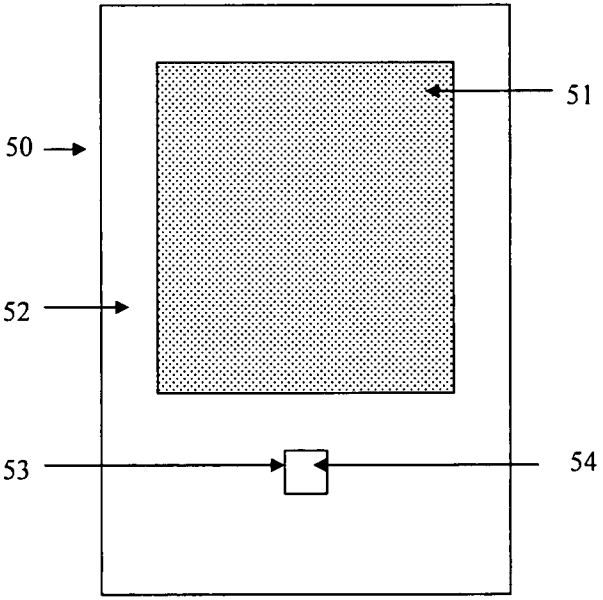

FIGS. 5*a*-5*c* show an example of a display device comprising an optical sensor.

Figure 6:
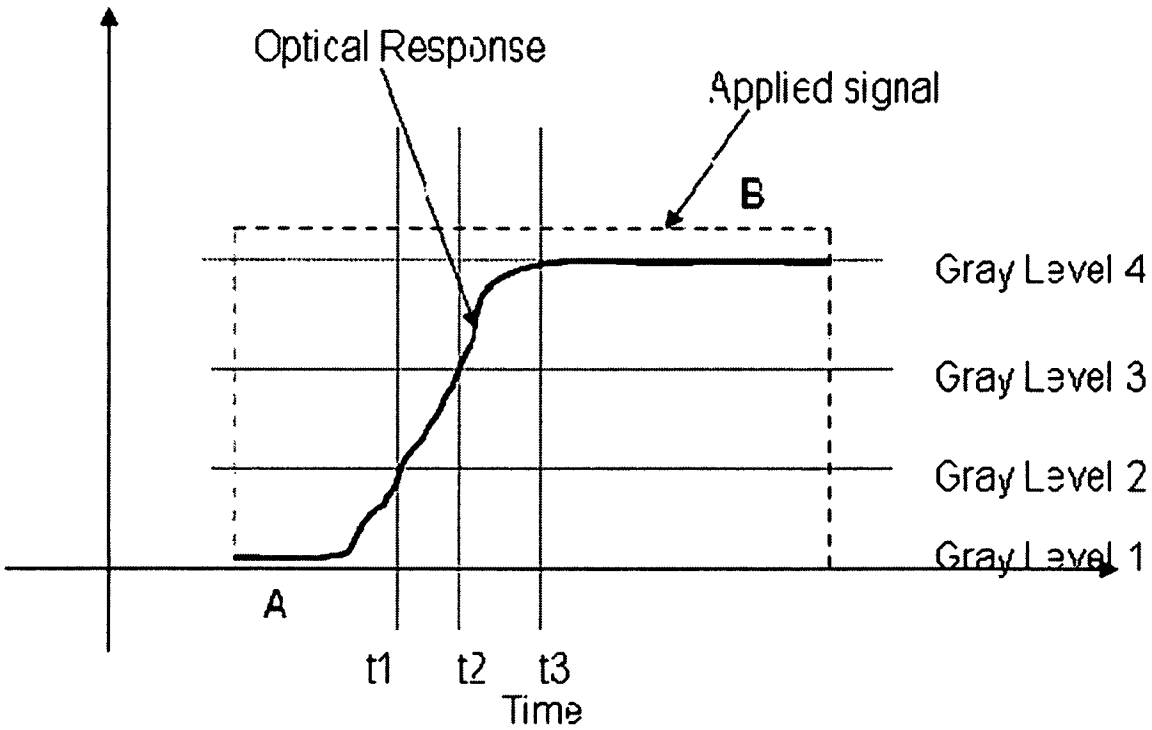

FIG. 6 is an example of optical response versus time.

Figure 7:
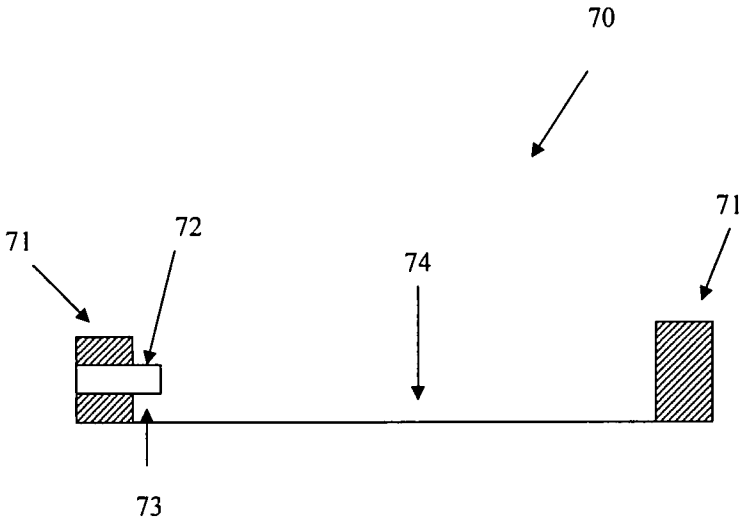
Figure 8:
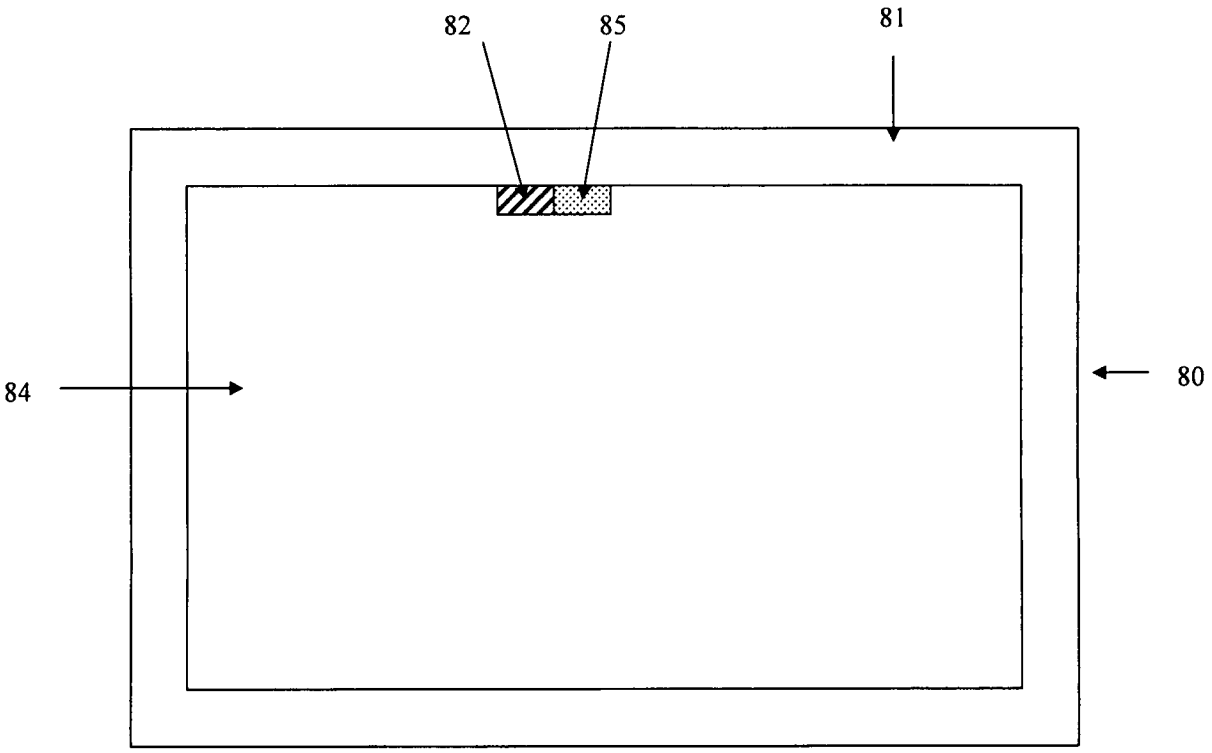
Figure 9:
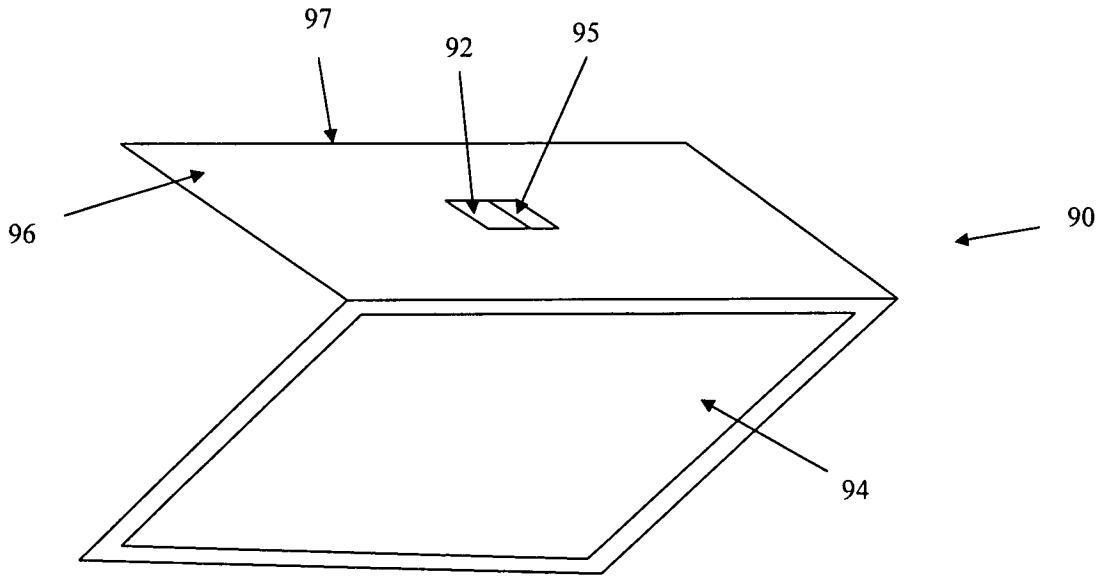

FIGS. 7-9 show examples of how a display device comprising an optical sensor may be configured.

Figure 10:
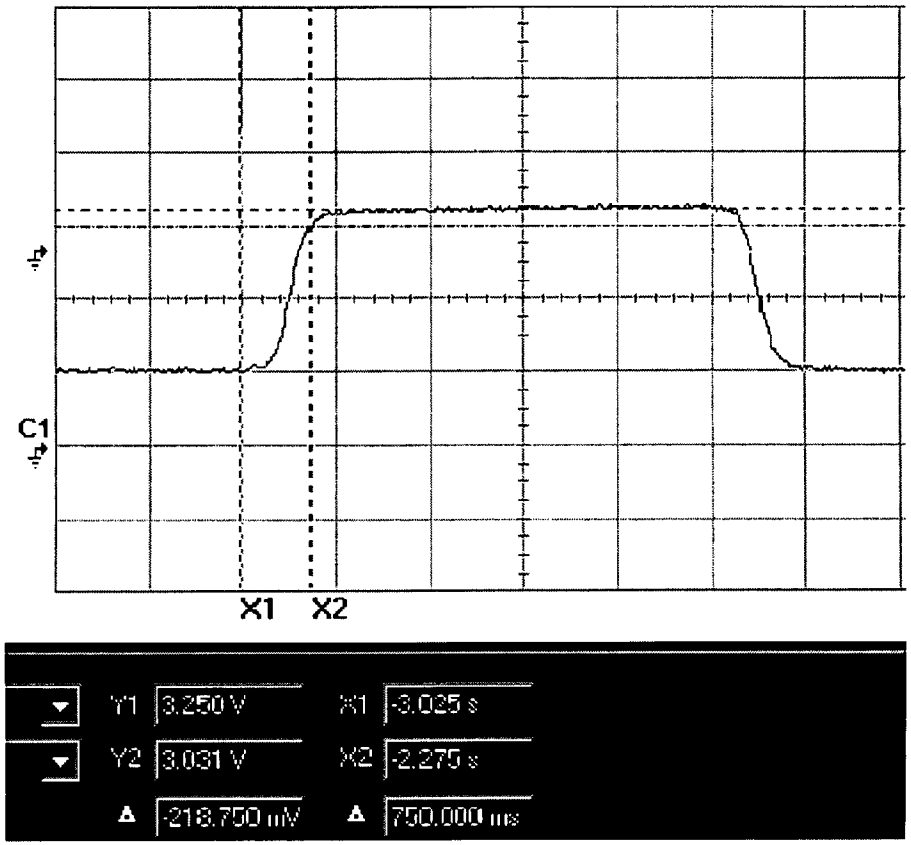
Figure 11:
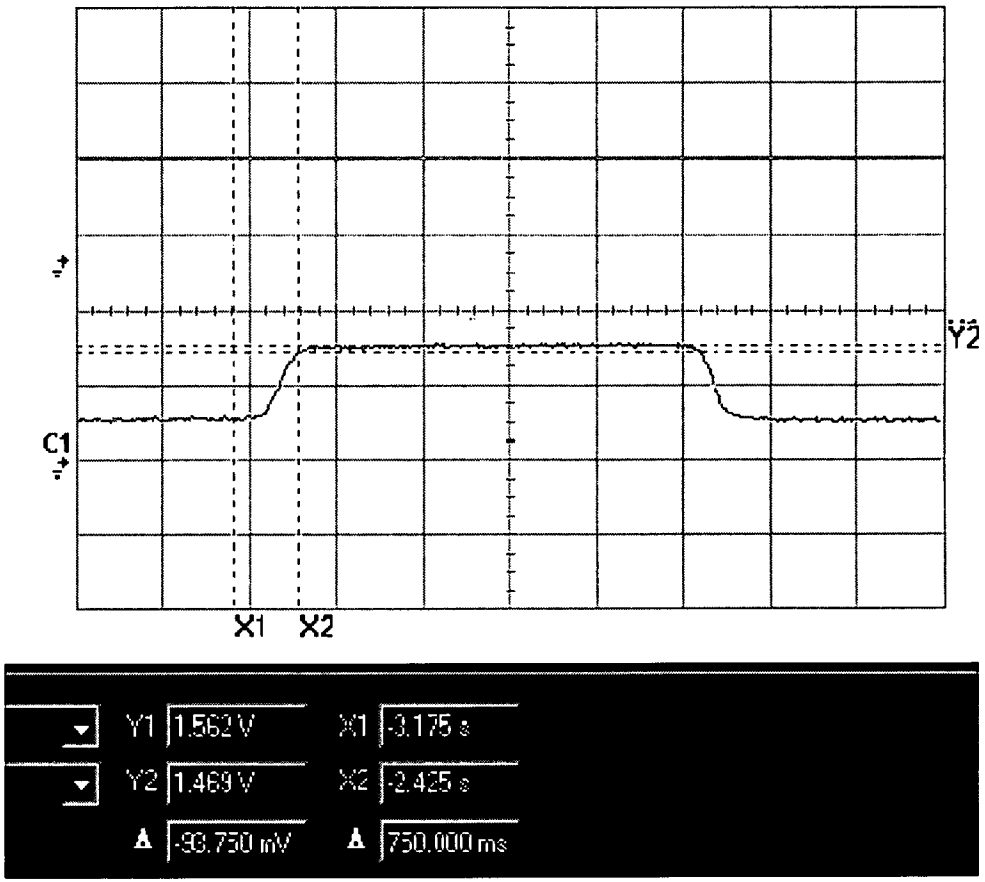
Figure 12:
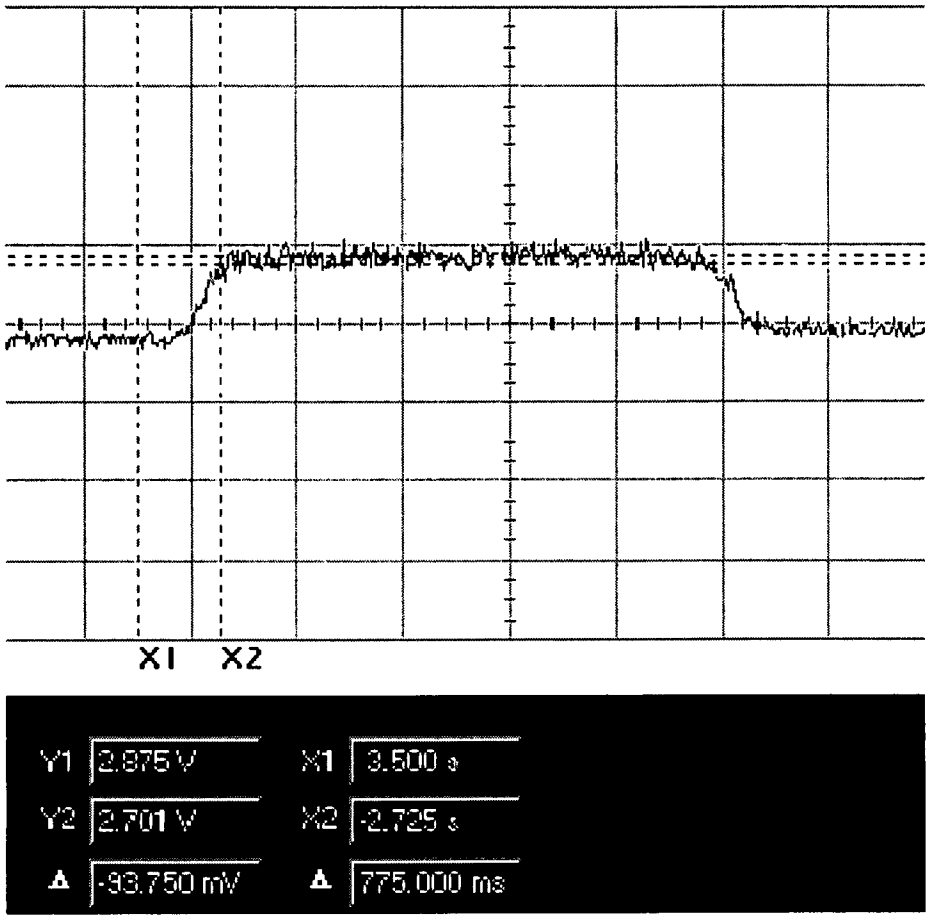

FIGS. 10-12 show the optical response curve recorded through a light-to-voltage converter under different light conditions.

DETAILED DESCRIPTION OF THE INVENTION

The present invention is directed to methods for adjusting or selecting driving waveforms (e.g., the timing of waveforms) in order to achieve a consistent optical performance of a display device. When a method of the present invention is applied, even if there are changes in the display medium due to temperature variation, photo-exposure or aging, the optical performance can be maintained at a desired level.

While electrophoretic displays are specifically mentioned in this application, it is understood that the present invention is applicable to any reflective, transmissive or emissive displays, such as liquid crystal displays, polymer-dispersed liquid crystal displays, electrochromic displays, electrodeposition displays, liquid toner displays, plasma displays, LED displays, OLED displays, field emission displays or the like. The display medium varies, depending on the type of displays involved.

As the optical response speed changes due to photo-exposure, temperature variation or aging, the pre-set waveform lengths are no longer adequate in driving a display medium to the desired color states. In the method of the present invention, it is first determined if the response time of an electrophoretic display medium has changed. After that determination, steps are carried out to compensate for the change. Such compensation may be accomplished by a variety of techniques. For example, a driving waveform may be lengthened to improve the image quality. Alternatively, it may be accomplished by predicting the rate at which the display medium will change and compensating for the anticipated change by pre-programmed adjustments. Further alternatively, it may be accomplished by measuring a certain parameter which is proportional to the response time of the medium and then providing adjustment to achieve the desired level. Yet further alternatively, it may be accomplished by measuring the performance of the display medium directly and feeding the result back to the waveform in a compensation mode to bring it back to the desired level. The details of these options are illustrated below.

The adjustment of the waveforms in order to achieve consistent optical performance may be a one-time adjustment (e.g., one-time testing of a display device at time of manufacture or at an arbitrary time set by the user), multiple time adjustments (e.g., every time when the display device is turned on, every time when the image changes or adjustments at regular intervals) or real-time adjustments (e.g., every time when the displayed image is updated).

In one embodiment of the present invention, the adjustment is achieved manually (e.g., manual contrast enhancement). In this approach, a button or other user interface control (e.g., knob, dial, touch screen button, slide or the like) is included in a display device which, when deployed, causes the waveform to be adjusted. This manual adjustment method is the simplest. The user only need to look at the images displayed in the viewing area to determine if the quality of the images is acceptable, and if not, adjustment may be made by simply turning a button or manual control until an appearance acceptable to the user is found. By turning the button or manual control to achieve acceptable appearance, proper waveforms are selected. This can be accomplished with hardware (e.g., a simple circuit), or software (e.g., algorithms or lookup tables) stored in the memory of a display device, or both. Longer waveforms will drive the display medium to a more saturated color state. Such a technique is inexpensive and may be used to accommodate for response time lengthening due to aging, photo-exposure or even temperature changes in the display medium.

To enable the user to judge when the quality of the images is optimized, several techniques may be employed.

For example, a fixed grey reference may be used. In this case, a printed test patch of a certain grey level is provided on the housing of a display device close to the viewing area of the display device. The user then interacts with the display device in a calibration mode to change the length of the waveform by turning a button or manual control until the grey level exhibited in the viewing area matches the grey level shown on the test patch as the user visualizes it.

Alternatively, a display medium based reference may be used. The display medium is driven in a calibration mode to generate two side by side small areas.

Figure 1:
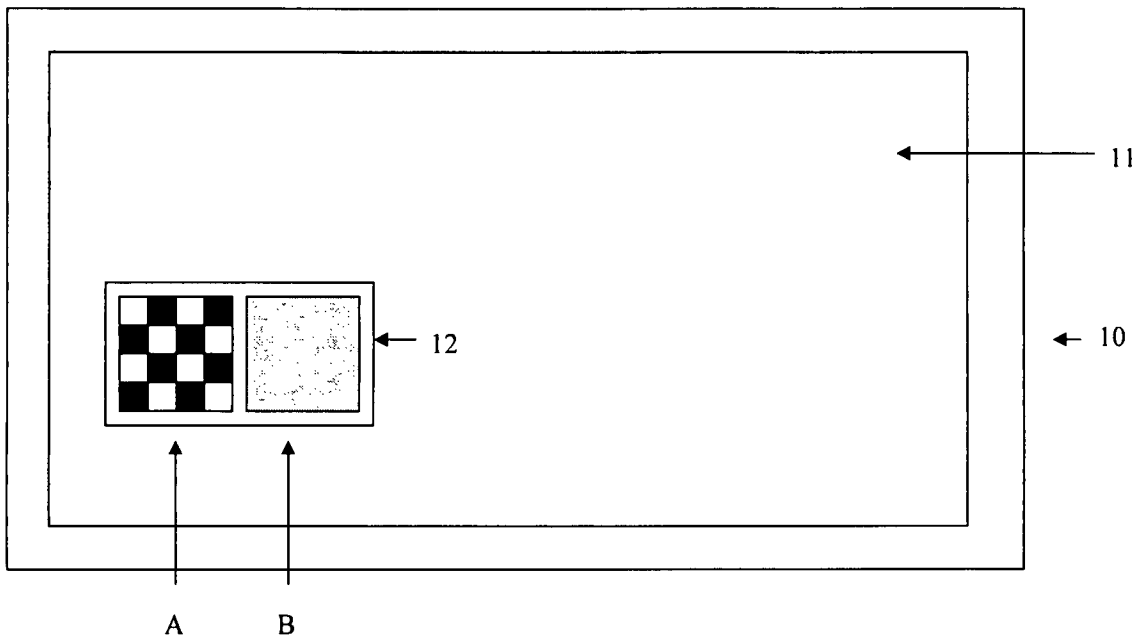
FIG. 1 illustrates how a grey level reference is implemented.

FIG. 1 shows an example of this approach. In the viewing area (11) of a display device (10), there is a calibration window (12) with two small areas (A and B) next to each other. The calibration window may be turned on and off. In practice, the size and location of the calibration window in the viewing area may vary. The shapes and sizes of the two areas A and B may also vary.

Area A, in this example, shows a checker-board pattern with 50% black squares and 50% white squares. The waveforms chosen are sufficiently long to drive the display medium in the black squares to the full black state and the display medium in the white squares to the full white state, regardless of the medium condition. For the checker board reference area A, because the display medium may have degraded, extra long waveforms may be needed to drive the squares to the full black and full white states.

The squares are of a very small size so that they are not individually distinguishable by naked eyes. For example, they may be 1-3 pixels wide. As a result, when the squares are viewed together, the checker board area is visually 50% grey, which, in this case, is used as a reference for comparison and adjustment purposes.

In area B, a waveform is applied to drive the entire area to a 50% grey state. The grey levels in areas A and B are compared. If the grey levels are not the same, the user may turn the button or manual control to drive area B to the same grey level as area A. The adjustment may have to be made more than once until the grey levels of both areas A and B are visually the same. In the process, a proper waveform is selected and the adjustment is then complete.

Utilizing this approach, the reference area A may be set at a grey level other than 50%. In any case, the level of grey detected in area B is compared to that in the reference area A and the driving waveform is adjusted accordingly to move the grey level in area B up or down to match the grey level in area A when the next image is displayed. Adjustment for a number of grey levels may be desired to achieve the best image performance.

Generally speaking, for a binary system of a first color state and a second color state, a reference area may comprise a number of small individual regions in the full first color state and a number of small individual regions in the full second color state and the ratio of the total area of the first color state to the total area of the second color state in the reference area may be adjusted to a desired level. In the 50% checker board example above, the ratio of the total area of the white state to the total area of the black state is 1:1. The ratio is an indication of the intensity (e.g., 50% or 70%) of the intermediate color between the full first and second color states.

The term "full color state" or "complete color state", in the context of this application, is intended to clarify that the color state is either the first color state or the second color state in a binary system, not an intermediate color between the two color states.

It should also be noted that the pattern of the reference area does not have to be the checker board pattern. It can be a striped pattern, a pattern of small circles, rectangles or other shapes or even a random pattern.

As also stated above, the individual regions in the full color states must be so small that they are not individually distinguishable by naked eyes.

Figure 2:
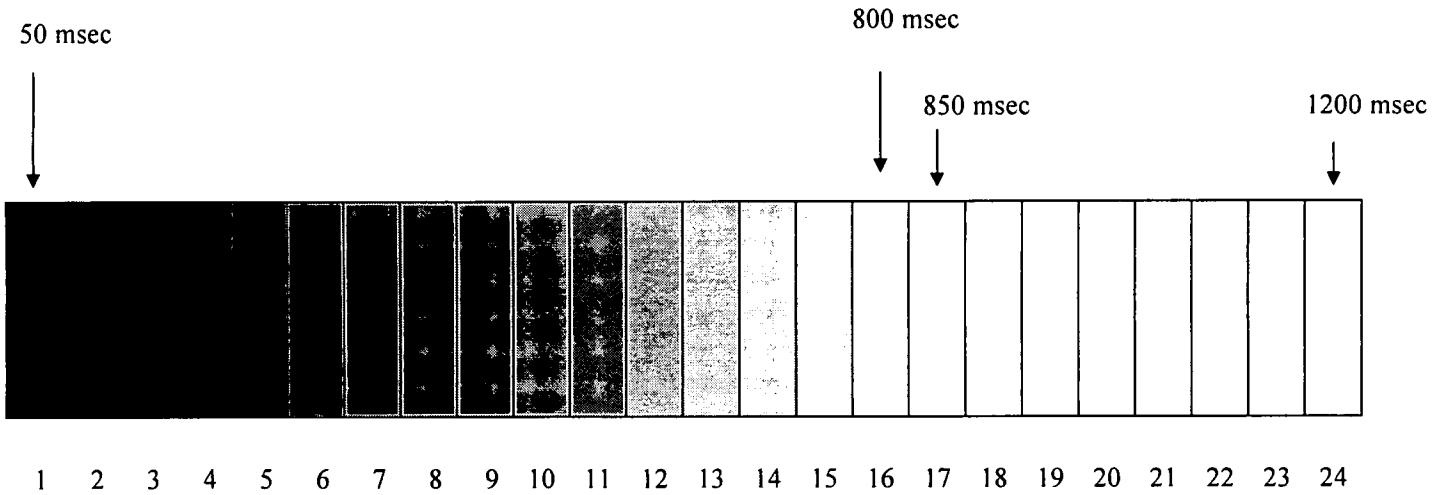
FIGS. 2 and 3 are alternative methods for manual adjustment.

FIG. 2 is another example of how manual adjustment may be implemented. In FIG. 2, there is a calibration window with 24 blocks showing different grey levels. The calibration window is seen in the viewing area of a display device and it may be turned on and off. It is noted that the arrangement of the blocks and the shapes and sizes of the blocks may vary, as long as they serve the desired function and purpose. The number of the blocks may also vary and be pre-selected. Each block is driven by a waveform of different length. The drive times for the blocks (1 to 24) are set, in this example, from 50 msec to 1200 msec, with 50 msec increments. In this case, the sequence of the 24 blocks is driven from the black state (in block 1) to different levels of the white state.

In FIG. 2, block 16 and block 17 show the lowest optical density (near complete whiteness) and the difference in optical densities between block 16 and block 17 has become undetectable visually. Based on this information, it can be deduced that the response time, i.e., the time required for driving the display medium from the full black state (in block 1) to the full white state (somewhere between blocks 16 and 17), is approximately between 800 msec and 850 msec. At this point, additional blocks may be added between blocks 16 and 17 with, for example, 2 msec increments. By fine toning the drive times for the blocks between blocks 16 and 17, a more precise response time may be determined.

However, in practice, a user does not need to know the exact response time. The user may simply input the block number which, in this case, is the first block in the sequence exhibiting a complete white state or the numbers of two neighboring blocks which have indistinguishable white levels. The built-in system will then select a set of appropriate waveforms for driving the display device.

In addition, by simply looking at the sequence of blocks and find where the block or blocks exhibit(s) a complete white state, the user could tell if adjustment of waveform lengths is needed. If the display medium has degraded, the response time will be longer. In other words, the user may see the two neighboring blocks having indistinguishable levels of whiteness shifting to the right side of the sequence. In this case, the user can make a manual adjustment to select different waveforms to bring the two blocks having indistinguishable levels of whiteness more to the left.

FIG. 2 shows that the blocks are driven from the black state to the white state. It is also possible to drive the blocks from the white state to the black state, and in that case, the response time is determined when two neighboring blocks having indistinguishable levels of complete black state.

Optionally, a visual reference mark may be displayed to indicate the length of the current driving waveform.

Figure 3:
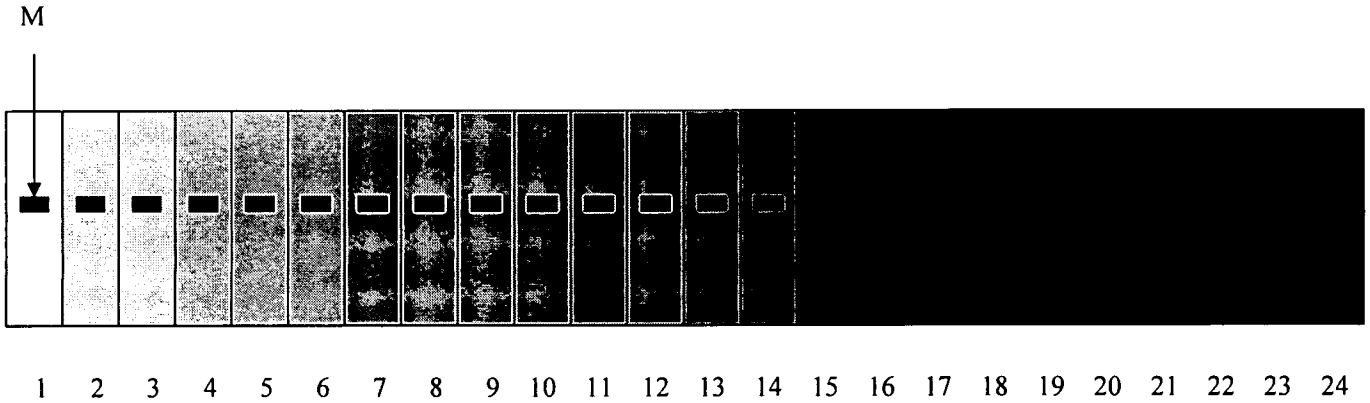

FIG. 3 shows another approach. The blocks in a calibration window are arranged in increasing grey levels, from block 1 to block 24. There is a marker (M) within each block. The marker can be of any shape or size. The marker may also be a number. For example, the marker in each box may be different and indicates the position of the block in the sequence. The marker in block 1 would be the number "1", the marker in block 5 would be the number "5", and so on. The marker areas in all blocks are driven to the full black state. The driving times for the blocks themselves, however, are set, starting at 50 msec for block 1 to 1200 msec for block 24, with 50 msec increments. In this example, the marker in block 17 is not visible because block 17 has been driven to the full black state. The response time (from the full white state to the full black state), in this case, is then about 850 msec. Again, there may be a visual display marker to indicate the length of the current driving waveform.

The user may then input the block number(s) into a built-in system and the system will select a set of appropriate waveforms for driving the display device.

If a display medium has degraded, the response time will be longer. In other words, the user may see a totally blacked out block more to the right, for example, block 20. In this case, the user may make a manual adjustment to select different lengths of waveforms through the built-in system to bring the totally blacked out block more to the left. Calibration and adjustment are therefore made.

In another embodiment, the adjustment is pre-programmed (i.e., programmed waveform lengthening). In this approach, the waveform is pre-programmed to become longer based on the age of the display medium or the number of imaging cycles so that as the display device becomes older, the waveform is automatically adjusted to be longer. Such a system will gradually slow down with use as the waveform becomes longer, but image quality will be maintained. The advantage of using this approach is that no human intervention is required and the device will run faster when it is newer, providing a better user interface and requiring less power to run.

In yet another embodiment of the present invention, the adjustment is achieved utilizing an "integrated photo-exposure" approach. In this approach, the waveform changes in length based on the integrated amount of photo-exposure as measured by a built-in photo-sensor. Such a system will gradually slow down with use as the waveform becomes longer, but the image quality will be maintained. Advantages of using this approach are that no human intervention is required and there will be correction for photo-exposure, which often is the major source of optical response slowdown. This approach will work well in applications where the light is on all the time such as those in the retail environment; but will work less well in applications where the light is intermittent such as e-readers, since there is partial recovery of the display medium when the light is turned off or the light is at low level. It can be conceived that a more complicated algorithm could be developed, which would take this into account and provide good correction even in that situation.

In a further embodiment, a temperature compensation approach is used. In this approach, the waveform changes with the temperature in accordance with a set of lookup tables. This has been previously described in, for example, U.S. application Ser. No. 11/972,150 filed on Jan. 10, 2008, the content of which is incorporated herein by reference in its entirety.

Figure 4:
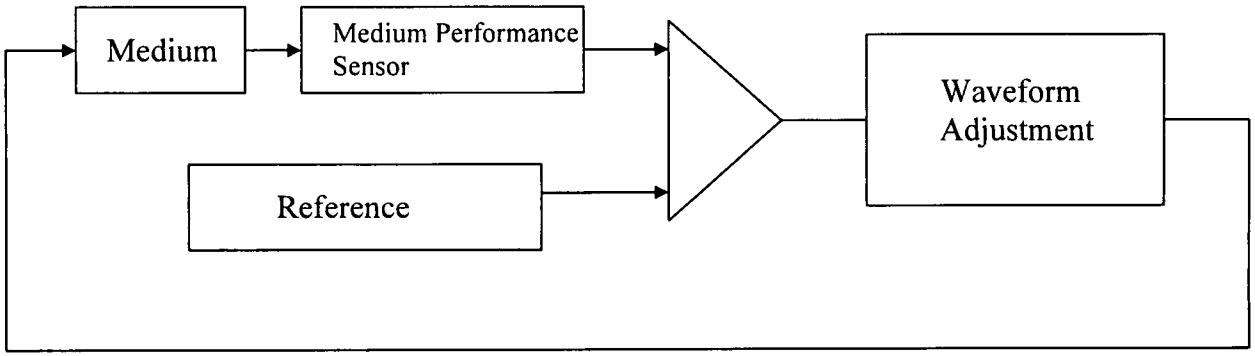
FIG. 4 shows a conceptual feedback circuit of the present invention.

FIG. 4 shows a typical active feedback circuit for the type of correction described in this patent application. The sensor output, whether it is a human feedback as described in this patent application or an optical sensor reading on the medium, is compared against a reference. When there is a difference between the feedback and the reference, an adjustment is made to the waveform to re-optimize the image quality. Normally as the medium ages, it may result in a slower response time, so the waveform will be adjusted to be longer to provide optimal optical performance. If the medium becomes warmer, it will run faster, so the waveform may need to become shorter to optimize the image quality. In any case, the waveform length is adjusted in the proper direction, changing the medium performance and thus impacting the sensor output, and then adjusted again until optimal performance is achieved.

Other than grey levels, the speed of the display medium may also be determined by measuring part of the current into the common electrode during image change. There are three major parts to this current, i.e., the capacitive charging of the ITO/backplane capacitor, the current resulting from the motion of the charged particles moving across the display medium, and the bias current resulting from ionic flow in the display medium. Since the time frame of each of these types of current is different, it may be possible to separate out the second source of current (i.e., the current resulting from the motion of the charged particles moving across the display medium) which would reflect the response time of the display medium. However, such a measurement is difficult because of the low current levels involved, but would be a very simple in-situ way to provide feedback for all sources of waveform length at once.

In yet a further embodiment, in situ optical density measurement is proposed. U.S. Application No. 60/979,708 filed on Oct. 12, 2007 describes compensation for response time changes by measuring the optical density in a display device with built-in optical sensor(s). The system also comprises a feedback circuit to change the waveform length(s) as needed, thus driving the optical density to the desired level. This is an excellent way to compensate for all response time changes.

FIGS. 5*a*-5*c* show an example of a display device comprising an optical sensor. FIG. 5*a* is the top view of a display device (50). The display has a viewing area (51) where images are displayed. The viewing area may be surrounded by a frame (52). An optical sensor (not shown) is located in a patch area (53) which is outside of the viewing area, and therefore the patch area does not interfere with viewing of the display device. The patch area is an extension of the viewing area, that is, both areas have the same display medium sandwiched between two electrode plates. Since the display medium changes with temperature, with age or with light exposure, it is important that the patch area (53) in the display device is exposed to the same environmental or aging history as the rest of the display medium, in particular the display medium in the viewing area.

The display surface (54) is exposed in the patch area, that is, the patch area is not covered by the frame.

FIG. 5*b* is a cross-section view of the patch area (53) which is surrounded by the frame (52), but not covered by the frame. The display surface (54) is exposed.

FIG. 5*c* is an enlarged view of the patch area (53). An optical sensor (55) is located above the display surface (54), preferably on the frame wall (52*a*). There may also be a light source (57), such as a LED or laser diode light source, above the display surface. The optical sensor and the light source may be adjacent to each other or kept apart. In any case, the optical sensor and the light source are not in contact with the display surface (54).

When in operation, the light source (57) generates light, which strikes the display surface (54) and reflects upward. The optical sensor senses the reflected light. The amount of the reflected light is an indication of the state of the pigment particles in the display medium. The optical sensor detects and measures the light reflected and in turn the optical response speed of the display device may be determined, based on how long it takes for the sensed reflected light to change to a new state. The optical density achieved for a given length and voltage level of a waveform may also be similarly determined based on the reflected light.

The system may be operated under ambient light, an artificial light source as described above or a combination of both. When the ambient light is present, the system may not be as reliable, since the intensity of the ambient light is not constant. In this case, an additional sensor to measure the ambient light may be necessary, in order to establish a reliable correlation between the light reflected and the optical response speed.

The optical sensor may also be made insensitive to ambient light by a number of techniques. One of the techniques is to modulate the light source involving temporal modulation codes. One of the temporal modulation codes may be frequency. In such a case, the temporal modulation frequency of the light is set at a level which does not tend to exist under ambient light (for example, at 100 khz) and as a result, the optical sensor output will be only proportional to the modulated light and not to the ambient light. Another option is to place a narrow band optical filter on the optical sensor and use a narrow optical frequency range from the light source, effectively filtering out the ambient light. A third option is to modulate the intensity of the light source with a more complicated modulation code, and then demodulate it in the sensor electronics with a correlation sensor which only provides a high response to that particular code. There are many such codes, the most common of which may be a pseudo-noise code or spread spectrum code, and such modulation/demodulation coding is well understood in the field of signal processing.

The optical sensor is controlled by a micro-controller in the display device. The display device may be turned on or off manually or automatically. When the display device is turned on, the micro-controller simultaneously turns on the light source and records the optical response detected by the optical sensor.

The feedback circuit of FIG. 4 may have an ambient light sensor (not shown), so that the reflected light may be calibrated.

FIG. 6 is an example of optical response versus time. An applied signal (see dotted line) is applied to switch the display device from one display state (marked A) to the other display state (marked B). For example, in a binary image system, one display state may be the white state and the other display state may be the dark state. The optical response speed can be deduced from the optical response curve recorded by the micro-controller. For example, the time required from driving the display device from one display state to the other display state (i.e., optical response speed determined based on the reflected light detected by the optical sensor) may be used as a basis to determine the next driving waveform (e.g., to adjust the pulse duration needed for the next driving waveform).

The grey levels may also be determined by the optical response curve as shown in FIG. 6. The figure shows four different levels of grey, 1, 2, 3 and 4. In other words, the optical response from one display state to the other display state has been divided into four substantially equal sub levels. To transition from the first grey level to the second grey level for a pixel, a driving waveform of length t1 is applied to the pixel. To transition from the first grey level to the third grey level the pixel, a driving waveform of length t2 is applied to the pixel. To drive the pixel from the first grey level to the fourth grey level, a driving waveform of length t3 is applied to the pixel. As shown, the lengths of the driving waveforms can be easily adjusted based on the optical response from the light data detected and measured by the optical sensor.

While FIG. 6 only shows four different levels of grey, it is possible to have more levels (e.g., 16, 32 or even more).

FIGS. 7-9 show additional examples of how a display device comprising an optical sensor may be configured.

FIG. 7 is a cross-section view of a display device. In this figure, a display device (70) has a supporting frame (71) around it. An optical sensor (72) is embedded in the supporting frame (71) of the display device. There is a gap (73) between the display surface (74) and the optical sensor (72). In other words, the sensor is not in contact with the display surface. The position of the optical sensor relative to the display surface may vary, depending on the specification of the optical sensor. In this embodiment, the light source is the ambient light. When the ambient light strikes the display surface, the light is reflected. As stated above, the intensity of the ambient light may not be consistent, and therefore a built-in mechanism may be needed in this case to take this factor into account.

FIG. 8 is an alternative design of the present invention. In this case, the light source is a combination of the ambient light and an artificial light source such as a LED light. Both the optical sensor (82) and the LED light (85) are embedded in the supporting frame (81) of the display device (80). As stated above, the optical sensor and the LED light may be adjacent to each other or kept apart. Both the optical sensor (82) and the LED light (85) are not in direct contact with the display surface (84), and the optical sensor measures the light reflected from the display surface.

FIG. 9 depicts a further alternative design of the present invention. In this design, the optical sensor (92) together with an artificial light source (95) is mounted on the inside surface (96) of the cover (97) of a display device (90). The optical sensor (92) and the artificial light source (95) are not in direct contact with the display surface (94) even when the display device is closed. The detection and measurement of the reflected light takes place when the display device is closed and the artificial light source (95) is turned on. The artificial light source (e.g., a LED light) is the only light source in this design and since the detection and measurement takes place when the display device is closed, interference from other lighting sources is avoided.

Alternatively, the adjustment may be accomplished by a more complicated grey level scan which can be used to calibrate an entire range of grey levels from dark to light. In the latter technique, multiple sensors and multiple patches may be needed. Alternatively, multiple driving waveforms are applied to obtain a full range of calibrations, one for each grey level.

The same mechanism as described above can be applied to multi-color displays. In that case, a color sensor will be used to record the intensity of each color, which is then used to adjust driving waveforms in order to maintain a desired level of intensity of the colors.

FIG. 10 shows the optical response curve recorded through a light-to-voltage converter under a strong spot light. FIG. 11 shows the optical response curve recorded through the same light-to-voltage converter under a weak spot light. FIG. 12 shows the optical response curve through the same light-to-voltage converter under normal ambient light. The response time from applying the signal to the ninety percent of the maximum optical response, calculated from the curves in FIG. 10, FIG. 11 and FIG. 12, respectively, is about 750 msec under all conditions, which seems to indicate that the response rate is independent of the intensity of light sources. The curve in FIG. 12 was affected by the noise from the ambient light, which can be de-noised before calculating the response speed.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, materials, compositions, processes, process step or steps, to the objective, spirit and scope of the present invention. All such modifications are intended to be within the scope of the claims appended hereto.

What is claimed is:

1. A method for adjusting the performance of an electrophoretic display device comprising a display medium, the method comprises the steps in the order of:

(a) providing a first set of driving waveforms and a sequence of blocks;

(b) driving the blocks from a first color state to increasing levels of a second color state with the first set of driving waveforms and identifying the location of a first block which is at the full second color state, which is indicative of a first response time required to drive from the first color state to the second color state;

(c) when the medium has degraded, driving the blocks from the first color state to increasing levels of the second color state with the first set of driving waveforms and identifying the location of a first block which is at the full second color state, which is indicative of a second response time required to drive from the first color state to the second color state, wherein the first block identified in step (b) is not the same first block identified in step (c), which is indicative that the second response time is longer than the first response time; and (d) inputting into a built-in system information of the location of the first block identified in step (c) for the built-in system to select a second set of driving waveforms for driving the display device.

2. A method for adjusting the performance of an electrophoretic display device comprising a display medium, the method comprises the steps in the order of:

(a) providing a first set of driving waveforms and a sequence of blocks wherein each of the blocks has a marker;

(b) driving the blocks from a first color state to increasing levels of a second color state with the first set of driving waveforms and driving all of the markers to the full second color state and identifying the location of a first block in which the marker is not visually detectable, which is indicative of a first response time required to drive from the first color state to the second color state;

(c) when the medium has degraded, driving the blocks from the first color state to increasing levels of the second color state with the first set of driving waveforms and driving all of the markers to the full second color state and identifying the location of a first block in which the marker is not visually detectable, which is indicative of a second response time required to drive from the first color state to the second color state, wherein the first block identified in step (b) is not the same first block identified in step (c), which is indicative that the second response time is longer than the first response time; and (d) inputting into a built-in system information of the location of the first block identified in step (c) for the built-in system to select a second set of driving waveforms for driving the display device.

3. The method of claim 1, wherein the second set of driving waveforms has time lengths longer than those of the first set of driving waveforms.

4. The method of claim 2, wherein the second set of driving waveforms has time lengths longer than those of the first set of driving waveforms.

5. The method of claim 3, wherein the time lengths have equal increments.

6. The method of claim 4, wherein the time lengths have equal increments.

* * * * *